US006601789B1

(12) United States Patent
Bajadali et al.

(10) Patent No.: US 6,601,789 B1
(45) Date of Patent: Aug. 5, 2003

(54) ROCK CRUSHER IMPACT SHOE

(75) Inventors: William J. Bajadali, Veradale, WA (US); Kyle P. Olmstead, Spirit Lake, ID (US)

(73) Assignee: Spokane Industries, Inc., Spokane, WA (US)

( * ) Notice: Subject to any disclaimer, the term of this patent is extended or adjusted under 35 U.S.C. 154(b) by 0 days.

(21) Appl. No.: 09/532,648

(22) Filed: Mar. 22, 2000

(51) Int. Cl.[7] ..... B02C 19/00
(52) U.S. Cl. ..... 241/301; 241/275
(58) Field of Search ..... 241/275, 300, 241/301

(56) References Cited

U.S. PATENT DOCUMENTS 4,586,663 A * 5/1986 Bartley ..... 241/197
4,787,564 A * 11/1988 Tucker ..... 241/275
4,940,188 A * 7/1990 Rodriguez et al. ..... 241/275
5,184,784 A 2/1993 Rose et al.
5,921,484 A 7/1999 Smith et al.
6,033,791 A 3/2000 Smith et al.
6,171,713 B1 * 1/2001 Smith et al. ..... 164/108

OTHER PUBLICATIONS

Brochure entitled "The Hard Rock Impactor" by Spokane Crusher Manufacturing Co.

* cited by examiner

*Primary Examiner*—Mark Rosenbaum
(74) *Attorney, Agent, or Firm*—Well St. John P.S.

(57) ABSTRACT

Disclosed is an impact shoe system generally for use in rock crushers, namely centrifugal rock crushers. This impact shoe system generally includes a plurality of wear inserts patterned within the impact shoe to substantially reduce the wear on the impact shoe, as well as to increase the useful life of the impact shoe.

1 Claim, 8 Drawing Sheets

ROCK CRUSHER IMPACT SHOE

TECHNICAL FIELD

This invention pertains to a rock crusher impact shoe system which provides a plurality of inserts patterned within the impact shoe to provide substantially increased wear resistance.

BACKGROUND OF THE INVENTION

Centrifugal impact rock crushers have been known for many years, and in a typical configuration, the input material are typically rocks and are loaded or input through an overhead hopper and then input or fed onto a spinning table which includes one or more impellers or impact shoes mounted thereon. The rocks impact the face of the impact shoes (also referred to as impellers) and are propelled or accelerated radially outward so as to collide with one or more of a plurality of anvils which typically surround the rotating impact shoe table.

There is a tremendous amount of impact, abrasion and substantial wear on the impact shoes and on the surrounding anvils.

FIG. 1 illustrates an exemplary centrifugal impact rock crusher 1, illustrating an input hopper 2, rocks 8 loaded into the input hopper 2 and being fed or metered onto rotating impact shoe table 3.

There are impact shoe supports 4 shown mounted on rotating table 3. Impact shoes 5 are mounted on impact shoe supports 4 on rotating table 3 and provide the hitting or impact surface which hits the rocks 8.

The rocks 8 are typically crushed or broken in two or more locations, the first being as a result of the impact with the impact shoes 5 and the second typically being when the rocks or parts thereof impact the radially outward anvils. The broken rocks 7 impacting the radially outward anvils 6 are shown in FIG. 1 after they are broken. In some cases, impact shoes 5 may make contact more than once with the same rocks or parts of the same rocks before they are propelled radially outward to the anvils 6. There may also be other impacts with rocks bouncing off the anvils and again impacting the impact shoes 5.

FIG. 2 shows the top cutaway view of a rock crusher 40, illustrating rotating impact shoe table 41 with impact shoe supports 42 mounted on rotating impact shoe table 41.

Impact shoes 43 are shown mounted on impact shoe supports 42 and rotating impact shoe table 41. There are other ways to attach impact shoes to the rotating impact shoe table, such as by direct attachment of the impact shoes to the rotating table and/or by placing a separate table piece on the top portion of the impact shoes to further attach and secure the impact shoes in place.

Radially outward from the rotating impact shoe table 41 are a plurality of anvils 44 contained within the centrifugal rock crusher housing and against which the partial or whole rocks may be impacted to break them into the desired pieces, as more fully described with respect to FIG. 1.

Due to the nature of their operation and function, the impact shoes 5 are very high wear components and must regularly be replaced to avoid damaging the impact shoe supports 4.

It is not uncommon on a typical impact shoe table for the table to rotate at approximately seven hundred fifty to two thousand revolutions per minute, or for the ends of the impact shoes to reach speeds up to or exceeding one hundred thirty (130) miles per hour, or greater. Higher speeds further accelerate the wear problem disclosed herein.

While the wear life of impact shoes on a rock crusher depends on many variables, such as the rock being crushed, the speed of the moving parts of the crusher, the desired size of the crushed rock, and other, a typical prior art impact shoe may for example have a useful life of approximately ten (10) operating hours before one or more of the shoes are worn out and must be replaced. It has been found that the impact shoe system disclosed herein, including the pattern or placement of wear-resistant inserts therein, has increased the wear-life of the impact shoes referred to in the example above, to approximately twenty five (25) hours.

There have been prior attempts to increase the wear-life of the impact shoes 5 by changing the composition of the material from which they are made and by placing certain contiguous inserts in the impact shoes to reduce the wear. There has not heretofore been an insert system which extends the life of the impact shoe to the extent this invention does.

FIG. 3 illustrates a typical wear pattern on one prior art impact shoe. The block outline 21 shows an example of the boundaries of an impact shoe 20 before it is used and worn. Impact shoe 20 has a radially inward surface 20*a* and a radially outward surface 20*b*. FIG. 3 shows an exemplary wear pattern on an impact shoe, the rocks moving from the inward surface toward the outward surface.

Finding a sufficiently better configuration to increase the wear life of the impact shoes by utilizing internal wear-resistant inserts is limited by certain issues which must be considered in manufacturing the impact shoes. Most of the shoes are cast and during casting it is important that there be sufficient metal surrounding the inserts to locate them in the desired location, and to support, hold or retain the inserts in the desired location. It is therefore difficult to develop a configuration which both increases wear life, and which can be reliably manufactured with inserts secured therein.

FIG. 4 illustrates a prior art impact shoe 30 with an insert 31 located within impact shoe 30. The insert 31 is a continuous piece and has a plurality of extended teeth portions 31*a* directed toward the face 32 of the impact shoe 30. The insert 31 in the prior art impact shoe 30 illustrated in FIG. 4 is believed to include a ceramic composition insert 31, which may be any one of a number of known compositions, such as ceramic compositions, which are generally known and used in the art. The prior art impact shoe 30 has radially inward side 30*a* and radially outward side 30*b* and would be attached to an impact shoe support via a mount portion 33.

The bulk of the wear resistance on the wear insert 31 is believed to be in the base portion and not the teeth 31*a*. If one were to attempt to place just the base portion 31 at or near the surface 32 of the impact shoe, it would likely not work because there would be insufficient metal holding the insert into place. It is believed that the prior art uses relatively thin fingers 31*a* in order to position the base portion off the surface 32 of the impact shoe mold allowing the base portion to be secured on all sides with metal during the pouring process.

The distances observed in the prior art shoe for finger width 78 are approximately one-quarter of an inch and for finger spacing 79 is approximately seven-eighths of an inch.

It is therefore an object of this invention to provide an impact shoe for use in a centrifugal impact crusher which increases the wear life beyond that heretofore achieved in the prior art. This invention achieves this objective by providing a plurality of separate or independent or separate wear resistant inserts for introduction and/or location into the impact shoes and provides such plurality in a variety of different patterns or configurations, as discussed and disclosed more fully below. This invention further provides an elongated insert spacing pattern wherein the ratio of the distance between inserts compared to the width of the insert is preferably less than two and one-half to one (2.5:1).

It has been found in comparing the useful or wear life between the prior art impact shoe shown in FIG. 4 and this invention, that the wear insert pattern and configuration provided by this invention outlasts the prior art shown in FIG. 4. This is believed to be because this invention has discovered that providing a plurality of spaced wear inserts provides a longer wear life, while at the same time allowing for sufficient metal flow during manufacturing to secure the inserts within the impact shoes.

BRIEF DESCRIPTION OF THE DRAWINGS

Preferred embodiments of the invention are described below with reference to the following accompanying drawings.

FIG. 5 is a perspective view of one embodiment of an impact shoe as contemplated by this invention, illustrating a plurality of locations for wear-resistant inserts;

FIG. 13 is a closeup view of a portion of the impact shoe shown in FIG. 7.

DETAILED DESCRIPTION OF THE PREFERRED EMBODIMENTS

Figure 1:
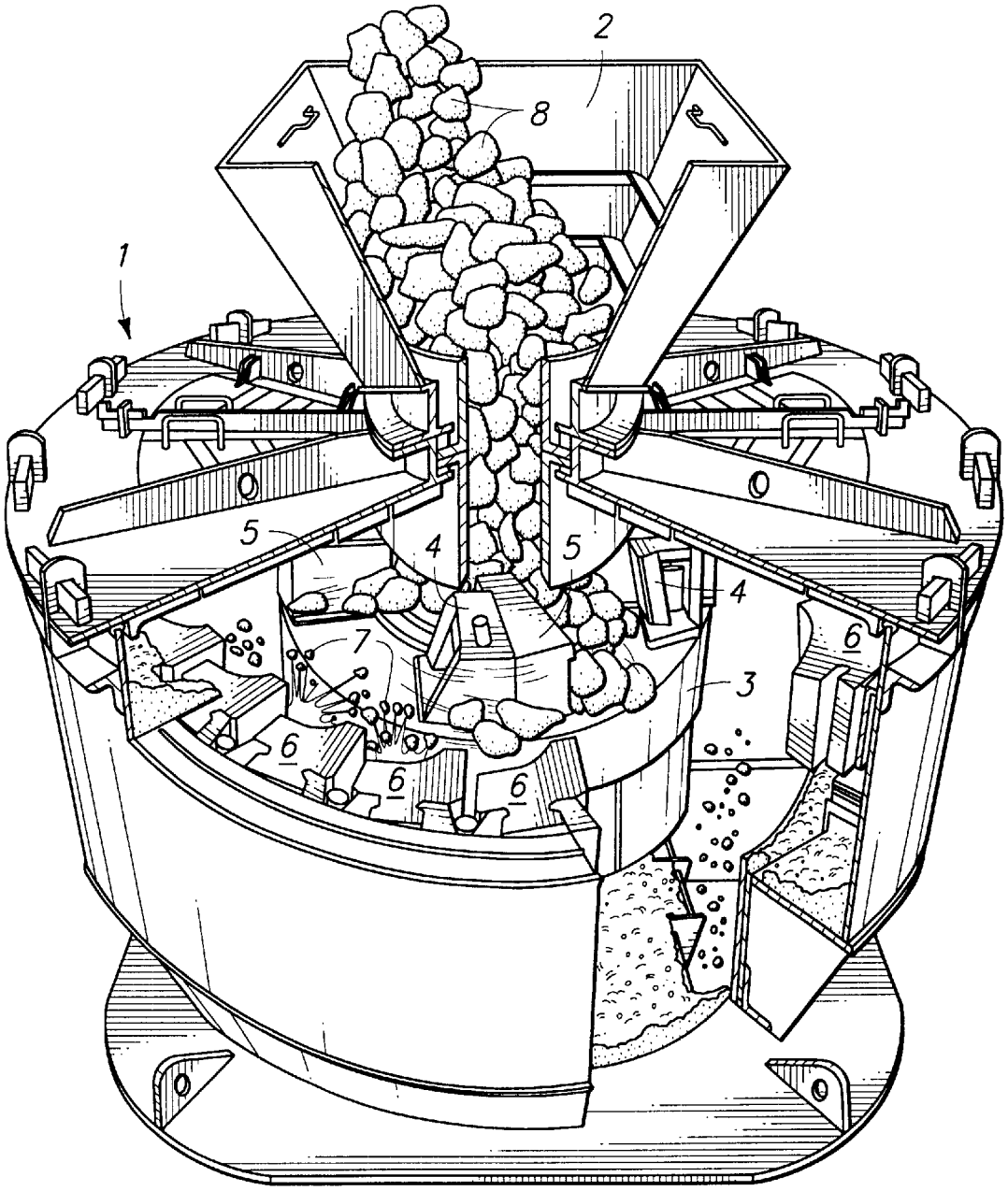
FIG. 1 is a perspective view of one example of a centrifugal impact rock crusher in which the inventionmay be used.
Figure 2:
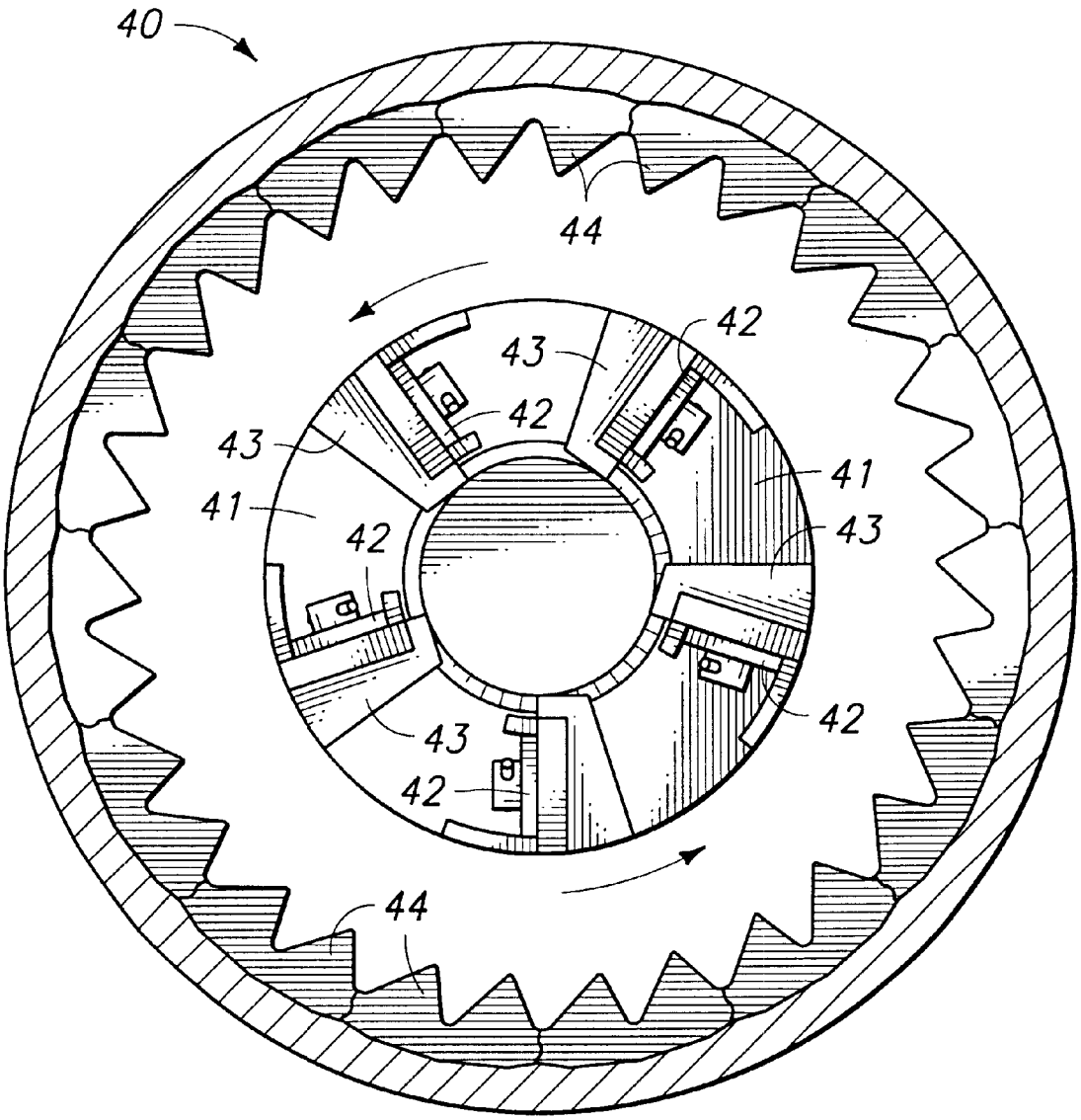
FIG. 2 is a cutaway top view of one example of a centrifugal impact rock crusher, illustrating a rotating impact shoe table and radially impact anvils.
Figure 3:
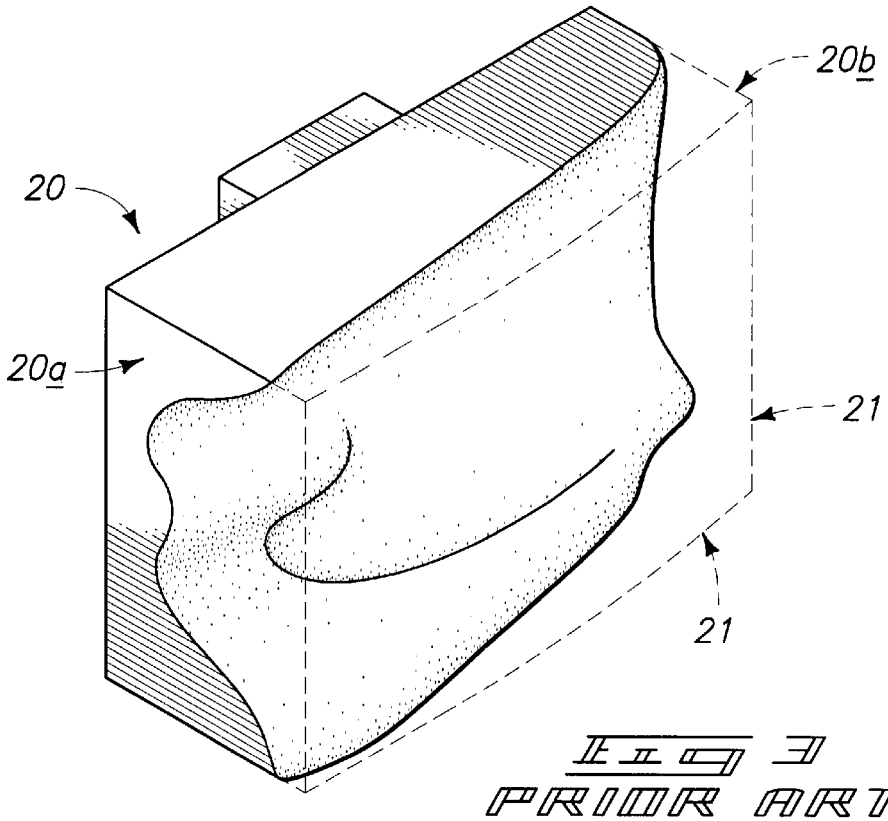
Fig 3 PRIOR ART
FIG. 3 is a perspective view of an exemplary prior art impact shoe with no inserts contained therein.
Figure 4:
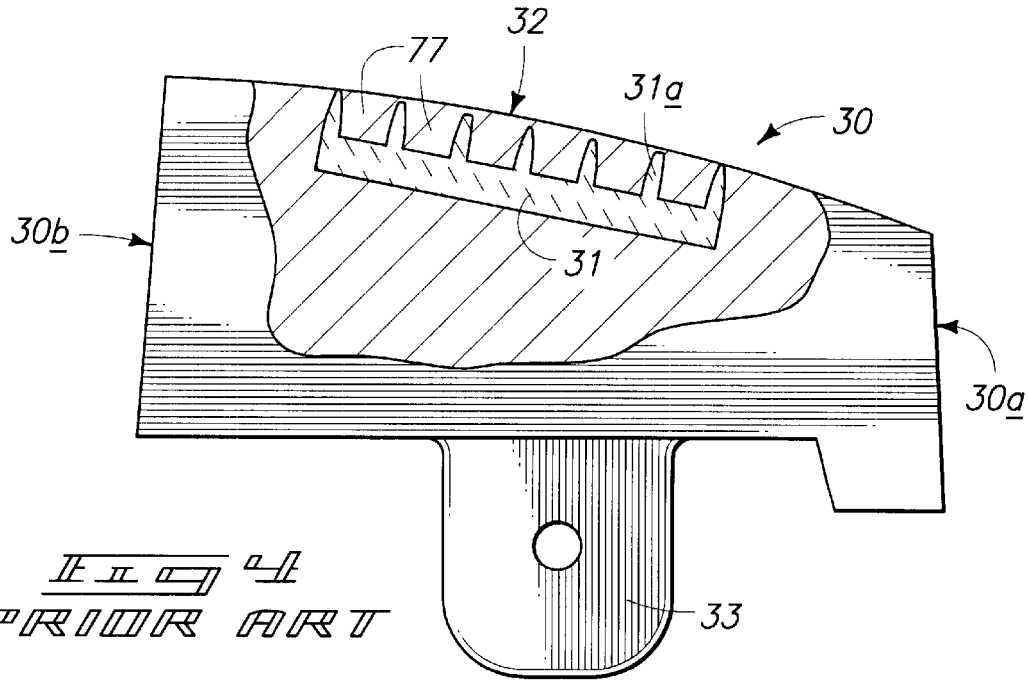
Fig 4 PRIOR ART
FIG. 4 is a top cutaway section view of an exemplary prior art impact shoe with a prior art insert contained therein.

Many of the fastening, connection, manufacturing and other means and components utilized in this invention are widely known and used in the field of the invention described, their exact nature or type is not necessary for an understanding and use of the invention by a person skilled in the art or science, and they will not therefore be discussed in significant detail. Furthermore, the various components shown or described herein for any specific application of this invention can be varied or altered as anticipated by this invention and the practice of a specific application of any element may already be widely known or used loin the art, or by persons skilled in the art or science, and each will not therefore be discussed in significant detail.

The terms "a", "an" and "the" as used in the claims herein are used in conformance with longstanding claim drafting practice and interpretation and not in a limiting way. Unless specifically set forth herein, the aforementioned terms are not limited to one of such items but instead are intended to mean "at least one".

The term impact shoe as used herein is intended to include impact shoes or impeller wear shoes, or any other wear surface for impacting the rocks for crushing, or propelling the rocks radially outward. The term elongated as used herein is used in the broad sense of being longer in the direction indicated that in the direction transverse thereto.

Due to the unique configuration of the plurality of separate or independent wear resistant inserts within the impact shoes, as contemplated by this invention, the impact shoes have been lasting substantially longer, and as much as two and one-half times longer than typical prior art impact shoe without any wear-resistant inserts contained therein. It is believed that the stepped configuration reduces the grooving of the impact shoes by the rocks colliding with and sliding along the impact shoe.

In a typical rock crusher, there are three to eight impact shoes which are generally changed when one or more of the shoes has become worn beyond its useful life, and therefore greatly improving the wear life has a significant effect on the cost to operate the rock crusher, and in the time savings benefit in the elimination or great reduction in the down time of the rock crusher.

There are numerous known compositions or combinations of materials which can be used to make the plurality of elongated inserts, including silicon oxides, aluminum oxides with carbides, zirconium, titanium oxide, alumina, brown fused alumina, to name just a few, which are all known in the art. No particular composition is required to practice this invention as all that is required is sufficient wear characteristics or toughness to be dissimilar from the base metal. Compositions typically used for grinding wheels for instance may also be used.

The base material for the impact shoe may also be any one of a number of compositions, no one of which is required to practice this invention. For instance, a high chromium white iron may be used.

It will be noted by those skilled in the art that impact shoes are also referred to as impeller shoes or impeller wear shoes, and the rotating impact shoe table is also sometimes referred to as the impeller table. Further, the impact shoe support as referred to herein may also be referred to as a gusset bracket, a gusset or an impact shoe support, which is fastened or affixed to the impeller table, as will be appreciated by those with ordinary skill in the art.

It should be noted that when the term "embedded" is used in reference to the wear-resistant inserts, it may be either partially or wholly embedded within the impact shoes, as contemplated by this invention, with some or none of the wear-resistant insert initially visible.

FIG. 5 is a perspective view of one embodiment of an impact shoe 50 as contemplated by this invention, illustrating impact shoe body 51 which is generally elongated, but need not be. Impact shoe body 51 includes a first end 511*a* (or inner end 51*a*) and a second end 51*b* (or outer end 51*b*). The first end 51*a* and the second end 51*b* represent a longitudinal direction on the impact shoe 50, with the plurality of wear-resistant inserts 52 being elongated and oriented in the transverse direction. The impact shoes have a transverse height and a longitudinal length.

FIG. 5 illustrates a first set or plurality of wear-resistant inserts 52, and a second set or plurality of wear-resistant inserts 53 embedded within the impact shoe.

Figure 6:
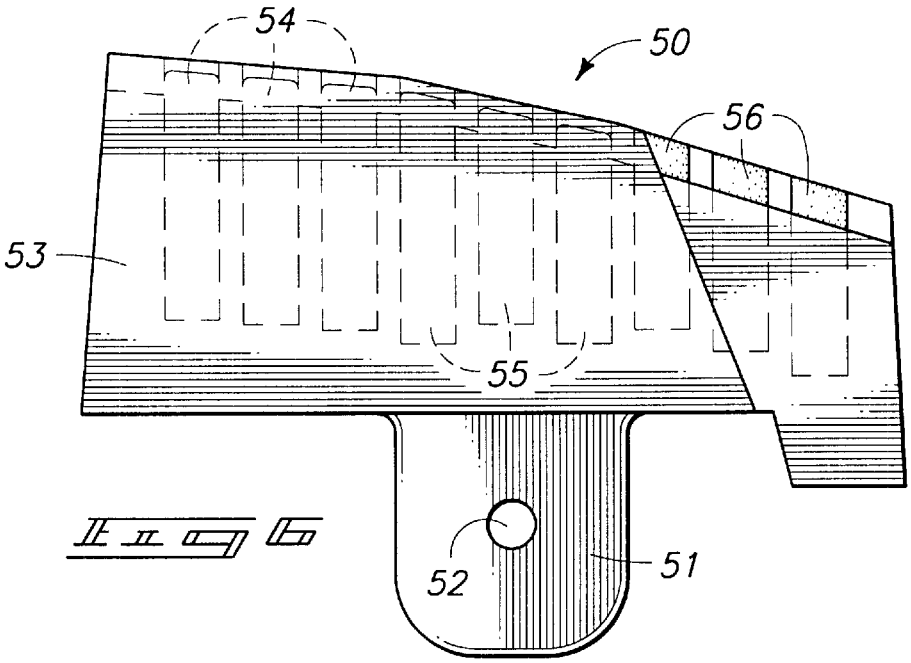
FIG. 6 is a top view of one embodiment of an impact shoe contemplated by this invention, illustrating the internal locations of the plurality of wear inserts.

FIG. 6 is a top view of one embodiment of an impact shoe 50 provided by this invention, illustrating an attachment flange 51 with aperture 52 to allow the impact shoe 50 to be attached to the impact shoe structure on the rotating impact shoe table. A pin or other retaining device may be placed through aperture 52 to secure impact shoe 50 to the impact shoe structure on the rotating table.

FIG. 6 further illustrates impact shoe body 53 with a plurality of elongated wear inserts embedded transversely therein. The wear-resistant inserts in the first set 54 or plurality of elongated wear resistant inserts, a second set 55 or plurality, and a third set 56 or plurality of elongated wear inserts are shown. The wear-resistant inserts in the first set 54 or plurality have a depth greater than the wear resistant insert in the second set and in the third set 56 of wear inserts.

It will be appreciated by those skilled in the art that there are numerous combinations of depths, lengths and widths between first, second and third sets of elongated wear inserts, and that additional sets may also be included at the same or different dimensions.

Figure 7:
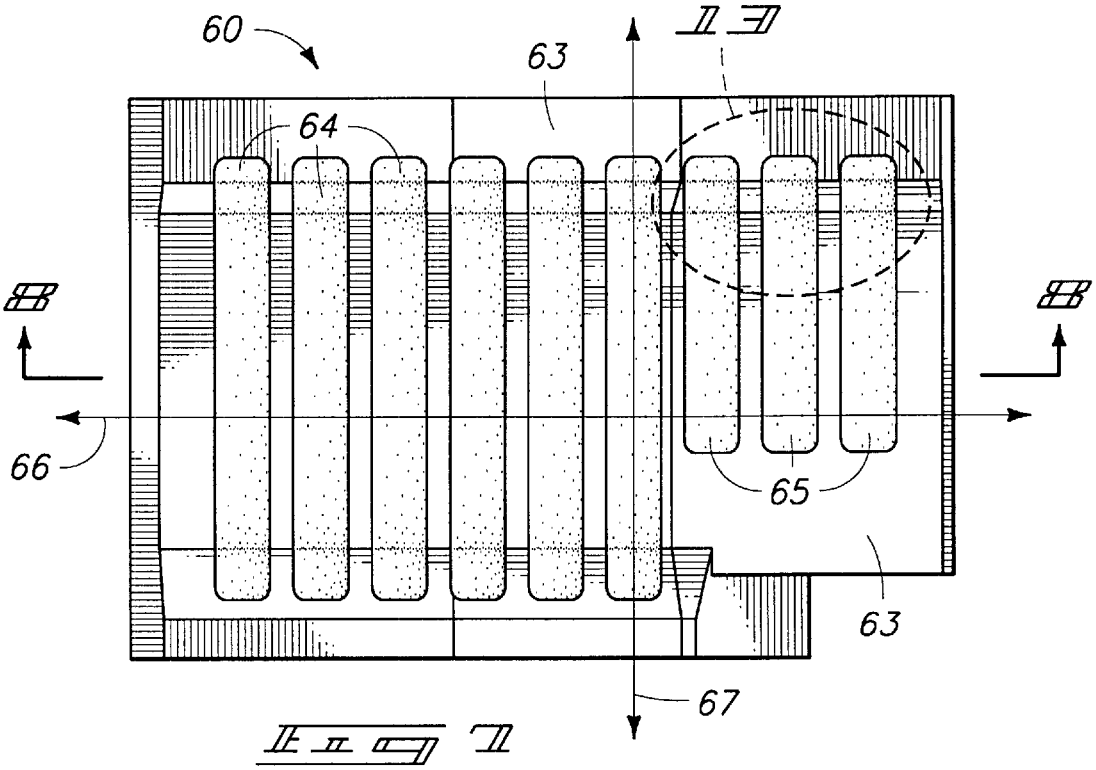
FIG. 7 is an elevation view of the face of one embodiment of an impact shoe contemplated by this invention, illustrating the locations of the wear-resistant inserts within the impact shoe.

FIG. 7 is an elevation view of one embodiment of an impact shoe 60 as contemplated by this invention. FIG. 7 illustrates an impact shoe body 63, a first set 64 of one or more elongated wear inserts transversely oriented within the impact shoe body 63. FIG. 7 further illustrates a second set 65 of one or more elongated wear inserts transversely oriented within the impact shoe body 63, and wherein the first insert set length is greater than the second insert set length. FIG. 7 also illustrates the relative directions or orientations, with line 66 representing the longitudinal direction of the impact shoe and line 67 representing the transverse direction of the impact shoe.

Figure 8B:
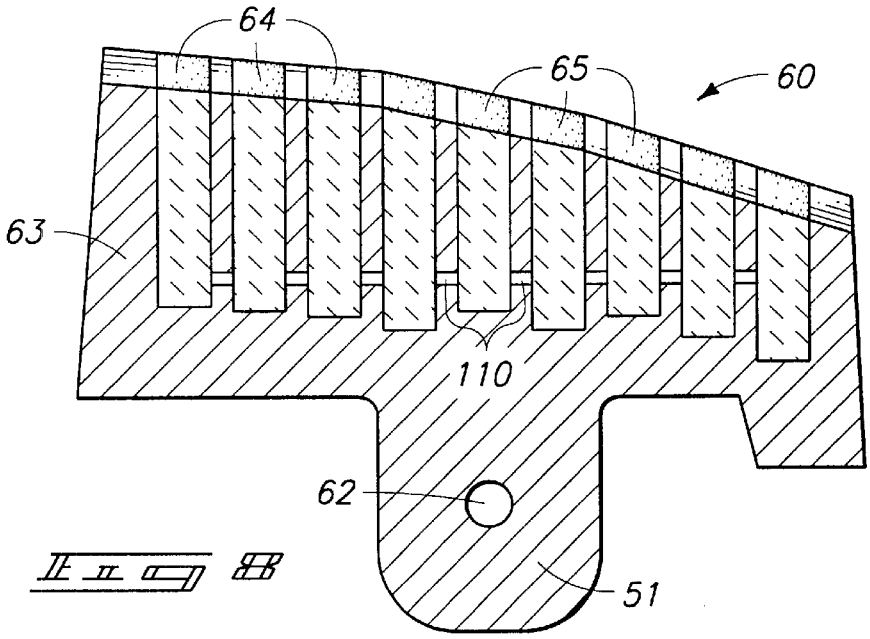
FIG. 8 is a section view 8—8 from FIG. 7, illustrating the impact shoe as shown in FIG. 7.

FIG. 8 is section 8—8 from FIG. 7 and illustrates the impact shoe 60, impact shoe body 63, a first set 64 of one or more elongated wear inserts transversely oriented within the impact shoe body 63, a second set 65 of one or more elongated wear inserts transversely oriented within the impact shoe body 63, aperture 62, and flange 51 for attaching the impact shoe 60 to the impact shoe support structure on the rotating table within the crusher.

FIG. 8 also illustrates connectors 110 which may hold the wear inserts in position with respect to one another. As the term separate is used herein in relation to the wear inserts, it is meant to and does include configurations as shown in FIG. 8 where there is some type of positioning connector between adjacent wear inserts.

Figure 9:
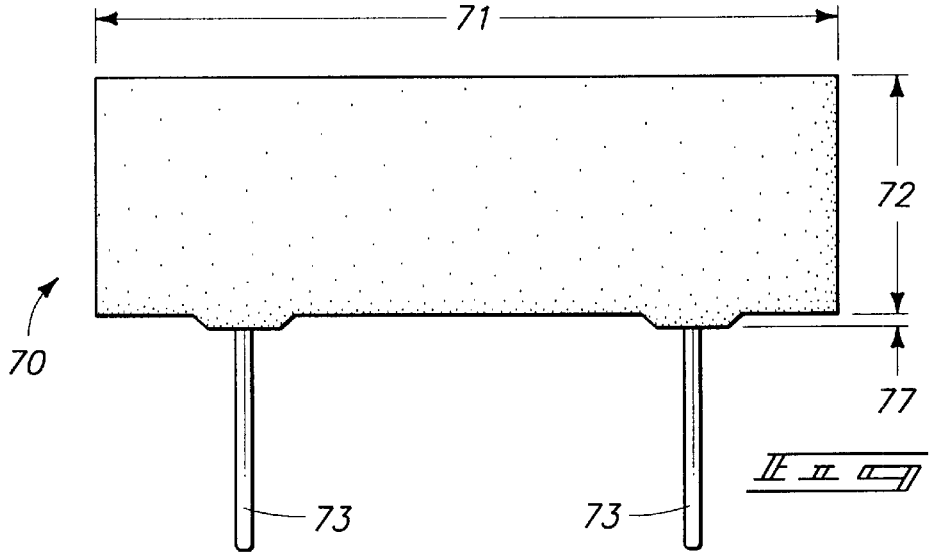
FIG. 9 is an elevation view of one embodiment of a wear-resistant insert to be placed in an impact shoe as contemplated by this invention.

FIG. 9 is an elevation view of one embodiment of an elongated wear insert 70, illustrating length 71, depth 72 and mold supports 73. The wear-resistant insert 70 is provided with one or more mold supports 73 which correspond to one or more mold apertures in the internal mold cavity in which the impact shoes are molded. The one or more mold apertures receive the one or more mold supports 73, which causes the wear-resistant insert 70 to be held or retained in place during the molding process such that it becomes embedded in the desired location within the resulting impact shoe.

After the one or more mold supports are inserted into the one or more mold apertures in the internal mold cavity, the separate wear-resistant inserts are retained in place and molten metal is introduced into the internal mold cavity in a process which is generally known by those skilled in the art. Once the molten metal substantially fills the internal mold cavity, the molten metal is cooled and thereby forms the impact shoe with the wear-resistant inserts embedded in the desired locations therein.

Distance 77 may be the distance under the surface of the impact shoe that the wear-resistant inserts are embedded.

While the preferred wear resistant insert shown is generally rectangular, it may be any one of a number of other or different shapes within the contemplation of this invention, with no one in particular required to practice the invention.

Figure 10:
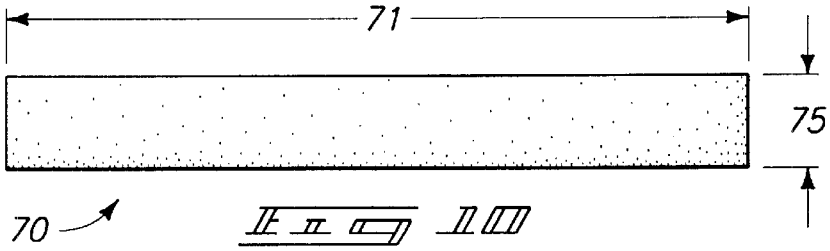
FIG. 10 is top view of one embodiment of a wear-resistant insert to be placed in an impact shoe as contemplated by this invention.
Figure 11:
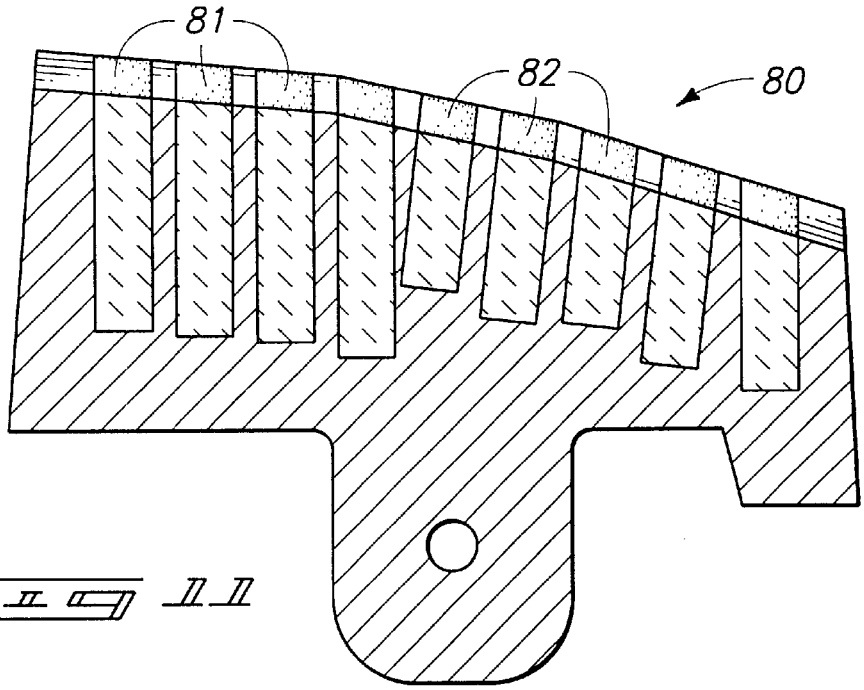

FIG. 10 is a top view of the wear-resistant insert 70 and illustrates the length 71 as well as the width 75 of the wear-resistant insert. A typical wear-resistant insert may be five and one-half inches in length, two inches in depth and five-eighths of an inch in width, with no particular configuration or size being required to practice the invention.

FIGS. 9 and 10 further depict a granular material, composition or structure from which the wear-resistant insert 70 may be constructed, as discussed more fully above.

Figure 11:
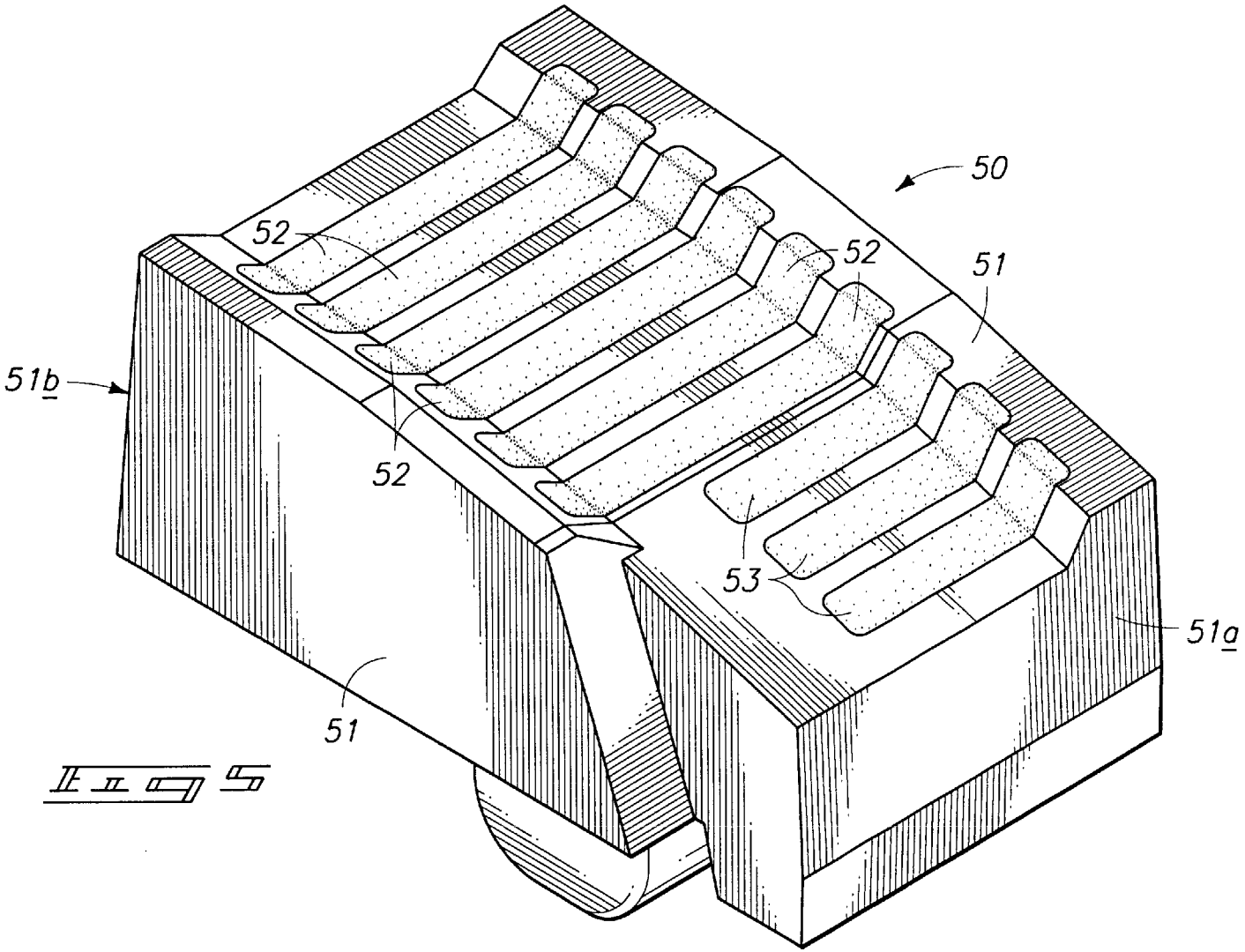
FIG. 11 is a top view of an embodiment of an impact shoe contemplated by this invention, illustrating the internal locations of the plurality of wear inserts wherein a first set of wear inserts are at a different angle than a second set of wear inserts.

FIG. 11 is an alternative section view to FIG. 8, to illustrate one embodiment or configuration contemplated by this invention wherein the impact shoe 80 has a first set 81 of wear-resistant inserts at a first angle relative to a vertical axis of the impact shoe 80, and a second set 82 of wear-resistant inserts at a different angle relative to an axis of the impact shoe 80.

Providing sets of wear-resistant inserts at different or varying angles may be used to vary or alter the wear patterns and wear life of the impact shoe 80.

Figure 12:
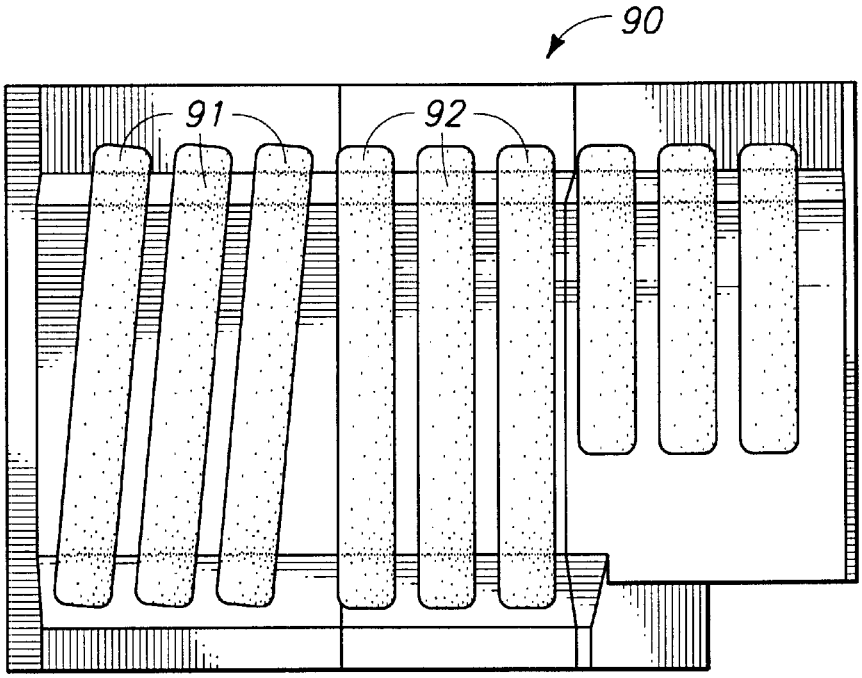
FIG. 12 is an elevation view of the face of one embodiment of an impact shoe contemplated by this invention, illustrating the locations of the wear-resistant inserts within the impact shoe, and wherein a first set of wear inserts are at a different angle than a second set of wear inserts.
Figure 11:
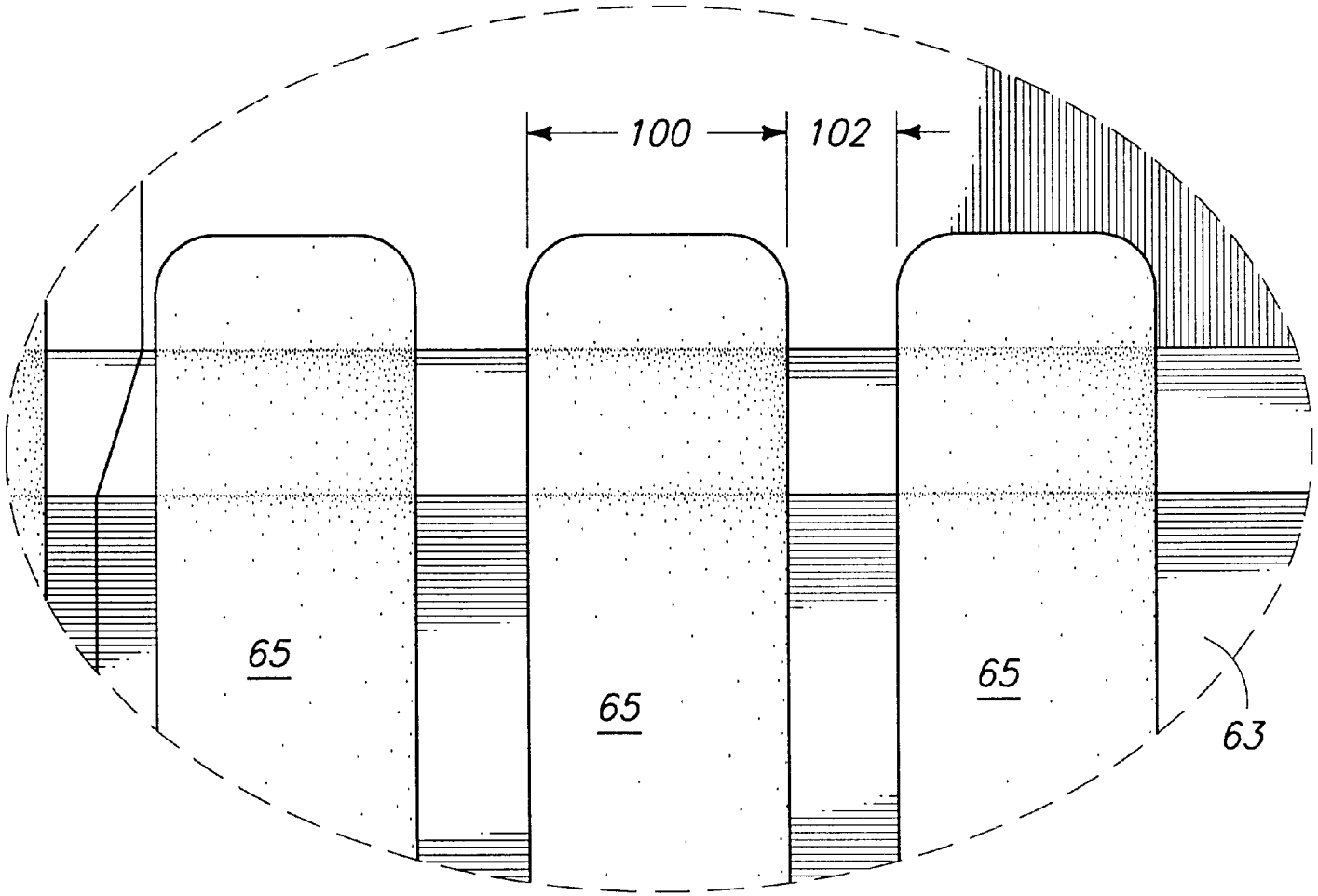

FIG. 12 is an elevation view of one embodiment of an impact shoe 90 as contemplated by this invention. In FIG. 12, a first set 91 of wear-resistant inserts is provided at a first angle relative to a longitudinal axis or a transverse axis of the impact shoe 90, and a second set 92 of wear-resistant inserts is provided at a second angle relative to an axis of the impact shoe 90.

Having a first set of wear-resistant inserts at an angle different than a second set of wear-resistant inserts may be utilized to vary or alter the wear pattern of the impact shoe 90.

FIG. 13 is a closeup view of the impact shoe shown in FIG. 7, and illustrates the width 100 of the preferred wear-resistant inserts 65 compared to the distance 101 between the wear-resistant inserts 65. The preferred width 100 is approximately five-eighths (⅝) of an inch, while the preferred distance 101 is approximately three-quarters (¾) of an inch. While the preferred range of ratios of the distance 101 to the width 100 is from two to one (2:1) down to one and one-quarter to one (1:1) or less, this invention contemplates ratios of two and onehalf to one (2.5:1) or less.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. An impact shoe for use on a rotating table in a centrifugal impact crusher, the impact shoe comprising:

a. an impact shoe body configured to be secured to an impact shoe support, the impact shoe body being elongated and having a longitudinal length in a longitudinal direction (66) and a transverse height;

b. the impact shoe body including a first set of one or more embedded elongated wear inserts transversely oriented within the impact shoe body relative to the longitudinal direction of the impact shoe body, and which are a first length;

c. the impact shoe body further including a second set of one or more embedded elongated wear inserts with a longitudinal side transversely oriented within the impact shoe body relative to the longitudinal direction of the impact shoe body, wherein the longitudinal side of the plurality of elongated wear inserts is positioned within the impact shoe body to act as a wear surface, and which are a second length; and wherein the first length is greater than the second length.

* * * * *

UNITED STATES PATENT AND TRADEMARK OFFICE

CERTIFICATE OF CORRECTION

PATENT NO. : 6,601,789 B1
DATED : August 5, 2003
INVENTOR(S) : Bajadali et al.

It is certified that error appears in the above-identified patent and that said Letters Patent is hereby corrected as shown below:

Column 3,
Line 23, replace "trifugal impact rock crusher in which the inventionmay be"
with -- trifugal impact rock crusher in which the invention may be --

Column 4,
Line 9, replace "element may already be widely known or used loin the art,"
with -- element may already be widely known or used in the art, --
Line 23, replace "direction indicated that in the direction transverse thereto." with
-- direction indicated than in the direction transverse thereto. --

Column 5,
Line 4, replace "need not be. Impact shoe body 51 includes a first end 511a"
with -- need not be. Impact shoe body 51 includes a first end 51a --

Column 6,
Line 59, replace "plates ratios of two and onehalf to one (2.5:1) or less"
with -- plates ratios of two and one-half to one (2.5:1) or less --

Signed and Sealed this

Thirtieth Day of December, 2003

JAMES E. ROGAN
*Director of the United States Patent and Trademark Office*